US006889453B2

(12) United States Patent
Maziere et al.

(10) Patent No.: US 6,889,453 B2
(45) Date of Patent: May 10, 2005

(54) METHOD FOR CONTROLLING THE MOISTURE CONTENT OF LINEN LEAVING A DRYING IRONER AND DRYING-IRONER IMPLEMENTING THIS METHOD

(75) Inventors: André Maziere, Saint Parres les Vaudes (FR); Arnaud Viger, Troyes (FR)

(73) Assignee: Electrolux Systems de Blanchinsserie, Rosieres-Pres-Troyes (FR)

( * ) Notice: Subject to any disclaimer, the term of this patent is extended or adjusted under 35 U.S.C. 154(b) by 312 days.

(21) Appl. No.: 10/272,780

(22) Filed: Oct. 17, 2002

(65) Prior Publication Data

US 2003/0079380 A1 May 1, 2003

(30) Foreign Application Priority Data

Oct. 25, 2001 (FR) ..... 01 13794

(51) Int. Cl.[7] ..... D06F 67/04
(52) U.S. Cl. ..... 38/44
(58) Field of Search ..... 38/44, 46, 49, 38/52, 66, 62, 3, 93; 219/248; 100/37, 38, 73, 92, 327; 73/73–77; 324/664–670

(56) References Cited

U.S. PATENT DOCUMENTS 4,197,663 A * 4/1980 Riedel ..... 38/3
4,712,472 A * 12/1987 Meisen et al. ..... 100/37
5,656,124 A * 8/1997 Krayenhagen et al. ..... 156/359
5,671,633 A * 9/1997 Wagner ..... 73/73
6,784,673 B2 * 8/2004 Tomasi et al. ..... 324/664

FOREIGN PATENT DOCUMENTS

DE 2219895 10/1973
DE 3436553 A1 4/1986
EP 1 0961053 A1 5/2001

* cited by examiner

*Primary Examiner*—Ismael Izaguirre
(74) *Attorney, Agent, or Firm*—Pearne & Gordon LLP

(57) ABSTRACT

To control the moisture content of linen leaving a drying ironer, this content is measured by means of a sensor (18). The measurement signal is then transmitted to a variable gain amplifier (30). A circuit (32) automatically adjusts this gain so that the signal leaving the amplifier (30) is non-saturated. This gives instant control of linen moisture content irrespective of the moisture content of the items of linen entering the machine.

12 Claims, 3 Drawing Sheets

Figure 1:
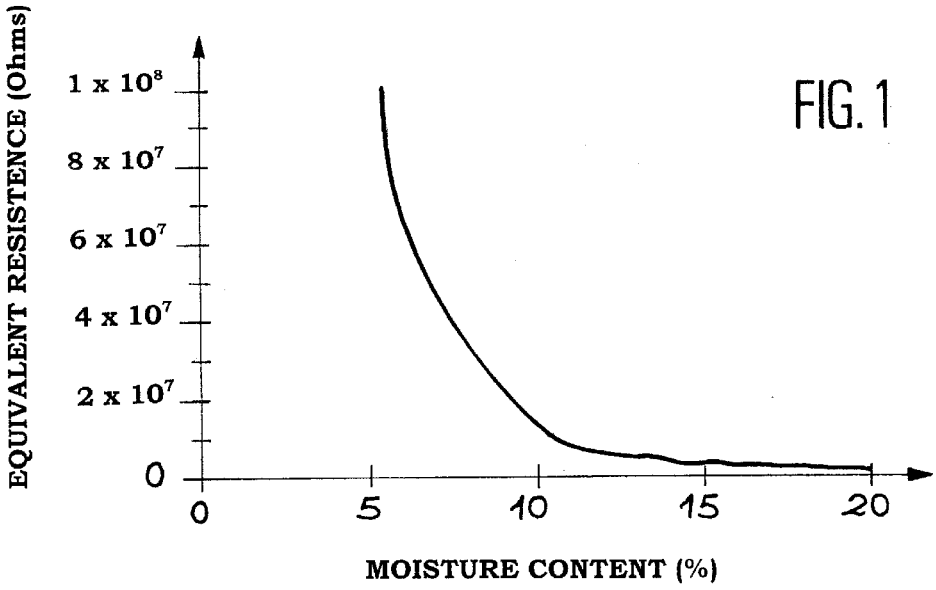

METHOD FOR CONTROLLING THE MOISTURE CONTENT OF LINEN LEAVING A DRYING IRONER AND DRYING-IRONER IMPLEMENTING THIS METHOD

TECHNICAL FIELD

The invention chiefly concerns a method for controlling the moisture content of ironed items of linen leaving a drying ironer.

The invention also concerns a drying ironer using this method, that is to say a drying ironer incorporating means able to maintain the moisture content of the ironed linen at a set value. If the linen comes from hospitals for example, the set value is sufficiently low to guarantee good microbial quality of the ironed linen, irrespective of the moisture content of the linen on entering the machine.

PRIOR ART

In a drying ironer, the items of linen to be ironed are placed between a rotating ironing roll and a complementary part which fits around the contour of part of the roll circumference. Heating means produce steam from the water contained in the linen pressed between these parts.

Drying ironers may be classified in two categories: "calender" drying ironers and "heating roll" drying ironers.

In calender drying ironers, the rotating ironing roll is lined with padding and is equipped on the inside with means to collect the steam and gases released by the linen. The linen items circulate between the roll padding and a metal tray called a "calender". The heating means are generally integrated in this metal calender.

In drying ironers with a heated roll, the heating means are positioned inside the metal roll whose outer surface is smooth and in direct contact with the linen. The items of linen circulate between the roll and endless fabric belts which are applied against the outer surface of the roll over part of its circumference. Aspiration means are provided behind the endless belts to collect steam and gas.

Regardless of the type of drying ironer used, the moisture content of the ironed linen leaving the machine depends upon numerous factors such as the type of fabric, its moisture content when entering the machine, the speed with which it passes through the machine, the heating temperature of the linen, etc.

If the linen to be ironed comes from a hospital for example it may contain bacteria. The speed of development of these bacteria is greater the higher the moisture content of the dried, ironed linen. To guarantee good microbial quality of the linen leaving the drying ironer, it is therefore highly advisable that its moisture content should be as low as possible.

Conversely, heating of the linen must not be allowed to exceed a certain value, beyond which there is a risk of burning the items to be ironed.

In most current machines, there is no device with which to control the moisture content of the ironed linen. Users of these machines are therefore obliged to manually adjust the linen travel speed and the heating temperature in relation to the type of fabric and its moisture content on entering the machines. For practical reasons, this adjustment made at the start of an ironing cycle which may be long is generally not changed until the end of this cycle.

It will be understood that such single, manual adjustment cannot guarantee good microbial quality of all the items of linen leaving the machine. To avoid burning the linen, the user is naturally prompted to make an adjustment such that only the items of linen of small size and in synthetic material have a satisfactory moisture content in this respect.

Document DE-A-34 36 553 describes a drying ironer in which the items of linen circulate between several sets of calender rolls placed in series. Each of the rolls is rotary driven at adjustable speed and comprises steam suction means fitted with a throttle valve with an adjustable opening. On leaving the machine, the items of linen are placed on a metal plate and their residual moisture content is measured between said plate and a point contact part by means of a Wheatstone bridge. The moisture content so measured is compared with an adjustable set value.

If the measured moisture content is higher than the set value, the throttle valve of the suction means of the first roll-calender assembly is opened gradually in the direction in which the linen travels, then the valve of the suction means of the second roll-calender assembly is opened and so forth until the desired moisture content is reached. If the moisture content still remains too high after fully opening all the throttle valves, the speed of rotation of all the rolls is reduced.

Conversely, if the measured moisture content is lower than the set value, the throttle valve of the last roll-calender assembly is gradually closed in the direction in which the linen travels, then the second to last assembly and so forth until the set moisture content is reached. If the measured moisture content remains lower than the set value after all the throttle valves have been closed, the rotation speed of all the rolls is increased.

The means for controlling the linen drying rate described in this document raise problems which make these means inefficient in practice.

The source of the first problem raised is to be found in the graph illustrated in FIG. 1 of the appended drawings, showing the variations in equivalent electric resistance (in Ohms) of an item of linen in relation to its moisture content. It can be seen from this graph that very small variations in this content lead to very large variations in equivalent electric resistance when the linen is not very moist (moisture content less than 6%). Conversely, when the linen is very moist (moisture content higher than 15%), the equivalent electric resistance of the linen is practically constant. Under these conditions, it does not appear possible in practice to control the moisture content of the linen directly on leaving the machine by means of a measurement made by a Wheatstone bridge of invariable characteristics as taught by document E-A-34 36 553.

Another disadvantage of the drying control means described in this document derives from the fact that the resistance of each item of linen is measured by causing it to pass between a metal plate and a point contact part. The measurement therefore undergoes substantial variations, in particular on account of full or partial electric contact losses between the contact part and the linen. These contact losses mean that the measurement made is practically impossible to use.

A further disadvantage of the control means described in document DE-A-34 36 553 derives from the fact that adjustment of the moisture content is made in priority by controlling steam suction. The consequence is a relatively long response time, incompatible with good microbial quality of the linen leaving the machine.

DESCRIPTION OF THE INVENTION

The subject of the invention is precisely a method for controlling the moisture content of linen items leaving a drying ironer, with which it is possible to solve, at least in part, the problems of the drying ironers of the prior art, in particular by ensuring effective control of the moisture content of the ironed linen, even when this content undergoes substantial variations during one same ironing cycle.

In accordance with the invention, this problem is solved using a control method for the moisture content of ironed linen items leaving a drying ironer, according to which the moisture content of the ironed linen items is measured, then at least one element of the drying ironer is monitored according to the measured moisture content, so that it can be moved towards a set value, characterized in that the measured moisture content is amplified with an instant optimised gain so that the measured moisture content so amplified has a non-saturated value, which is used to monitor said element of the drying ironer.

By means of this method, the amplification gain is automatically adjusted in relation to the value of the measurement signal, so as to obtain a non-saturated output signal which can then be used to correct the moisture content of the linen leaving the machine. Efficient, practically instantaneous adjustment of this content is therefore obtained irrespective of the moisture content of the linen when placed in the drying ironer.

Advantageously, a maximum value is given to the gain, then the gain is divided by a given factor, as many times as necessary, until the measured, amplified moisture content shows said non-saturated value. Preferably, the dividing factor is given a value that is substantially equal to two.

If no measurement is made of the moisture content of an ironed item of linen, that is to say when no item of linen leaves the machine, the optimised instant gain is advantageously kept unchanged for a predetermined length of time after the end of the measurement of the last item of linen ironed. With this characteristic, it is possible to avoid recommencing measurements using the maximum gain value when several items of linen are ironed one after the other.

Further advantageously, several moisture content measurements are made successively, the measurement signals are smoothed and the average is calculated before they are amplified with said instant optimised gain. With this characteristic it is possible not to take into account any abnormal measurements when controlling the moisture content of the linen.

A further subject of the invention is a drying ironer comprising means for measuring the moisture content of ironed linen items leaving the drying ironer, said measurement means being able to deliver a measurement signal in the presence of an item of linen, and control means that are sensitive to the measurement signal so as to adjust the moisture content by acting on at least one element of the drying ironer, characterized in that the control means comprise means for variable gain amplification of the measurement signal and means for automatic gain adjustment able to give the gain of the amplification means an optimised value, so that the amplification means emit a non-saturated output signal.

According to one preferred embodiment of the invention, the element on which the control means act is a means for adjusting the speed of travel of the linen items in the drying ironer. These adjustment means can in particular vary the rotation speed of the ironing roll in the machine.

Preferably, the means for measuring the moisture content comprise two electrically conductive parts each comprising at least two (preferably five) flexible tongues able to be placed simultaneously in contact with the items of linen leaving the drying ironer, the flexible tongues of both conductive parts being arranged in alternate manner so as to form as many element sensors as there are pairs arranged in parallel.

Advantageously, the machine also comprises means for measuring the moisture content of the linen items to be ironed on entering the drying ironer.

Preferably, the machine also comprises means for recording the measurement signal to provide maximum traceability of the ironed linen.

SHORT DESCRIPTION OF THE DRAWINGS

Figure 2:
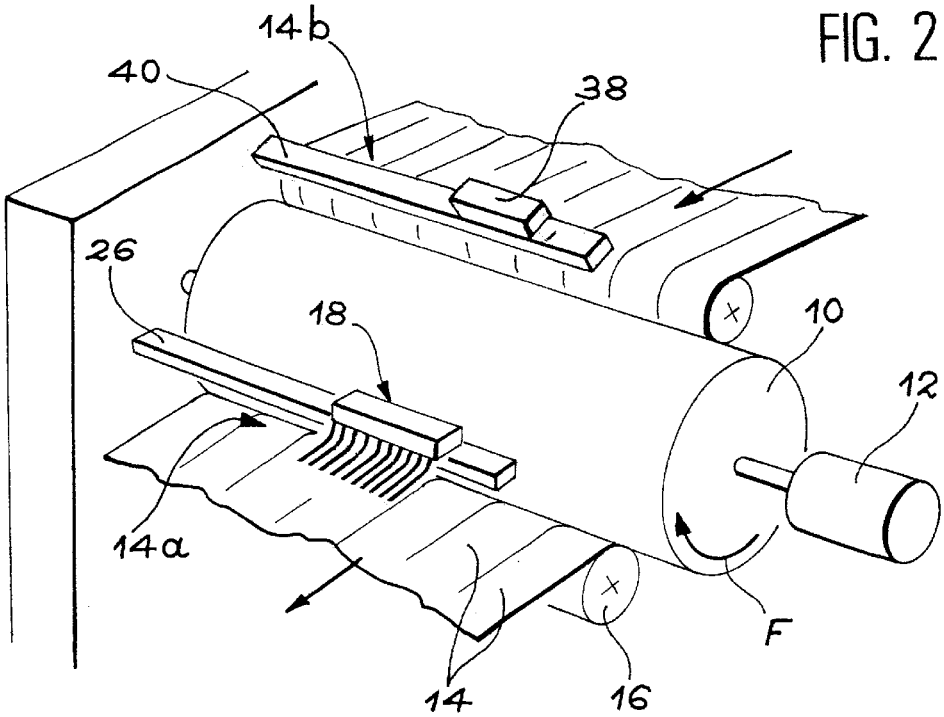
Figure 3:
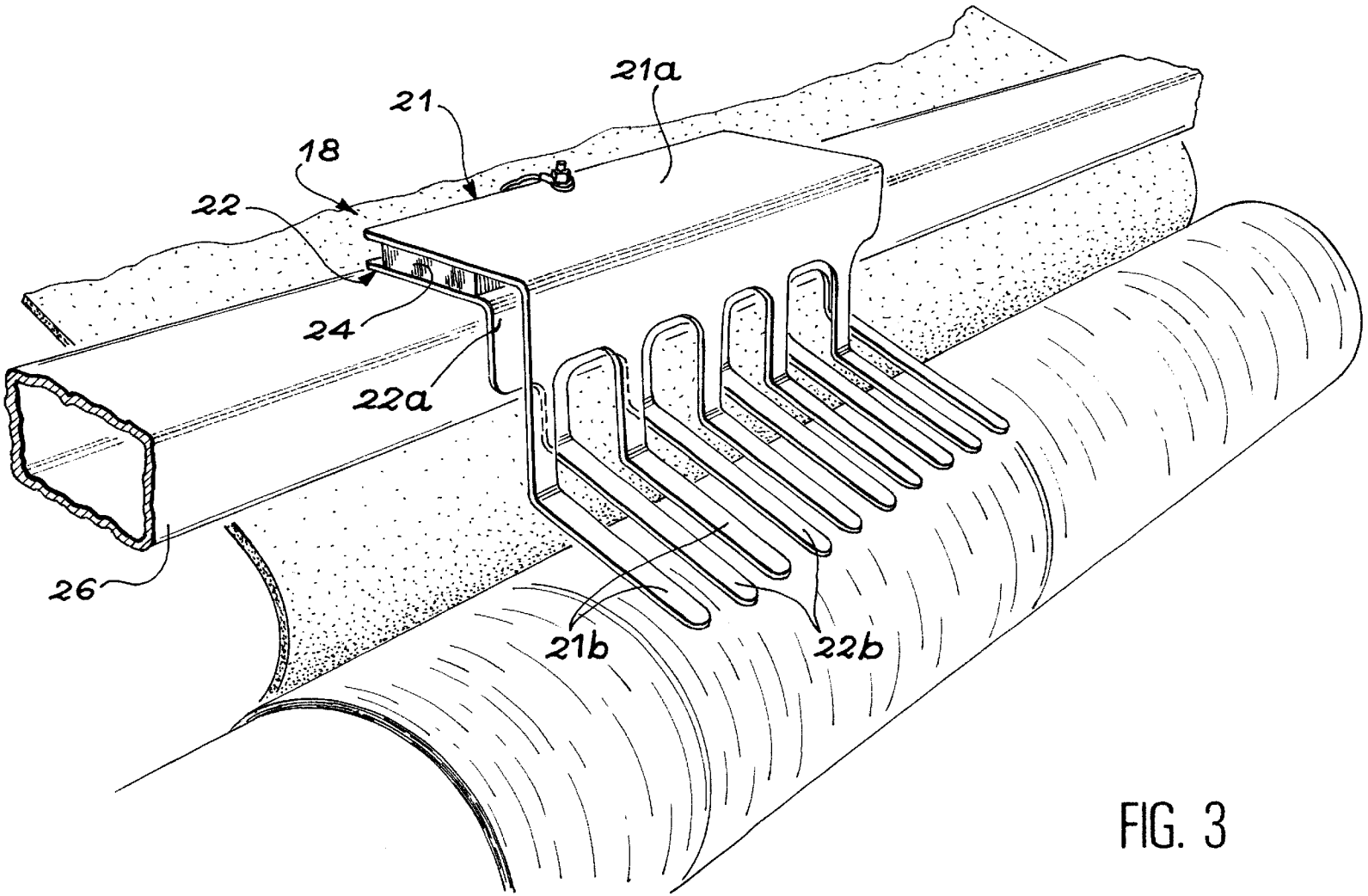
Figure 4:
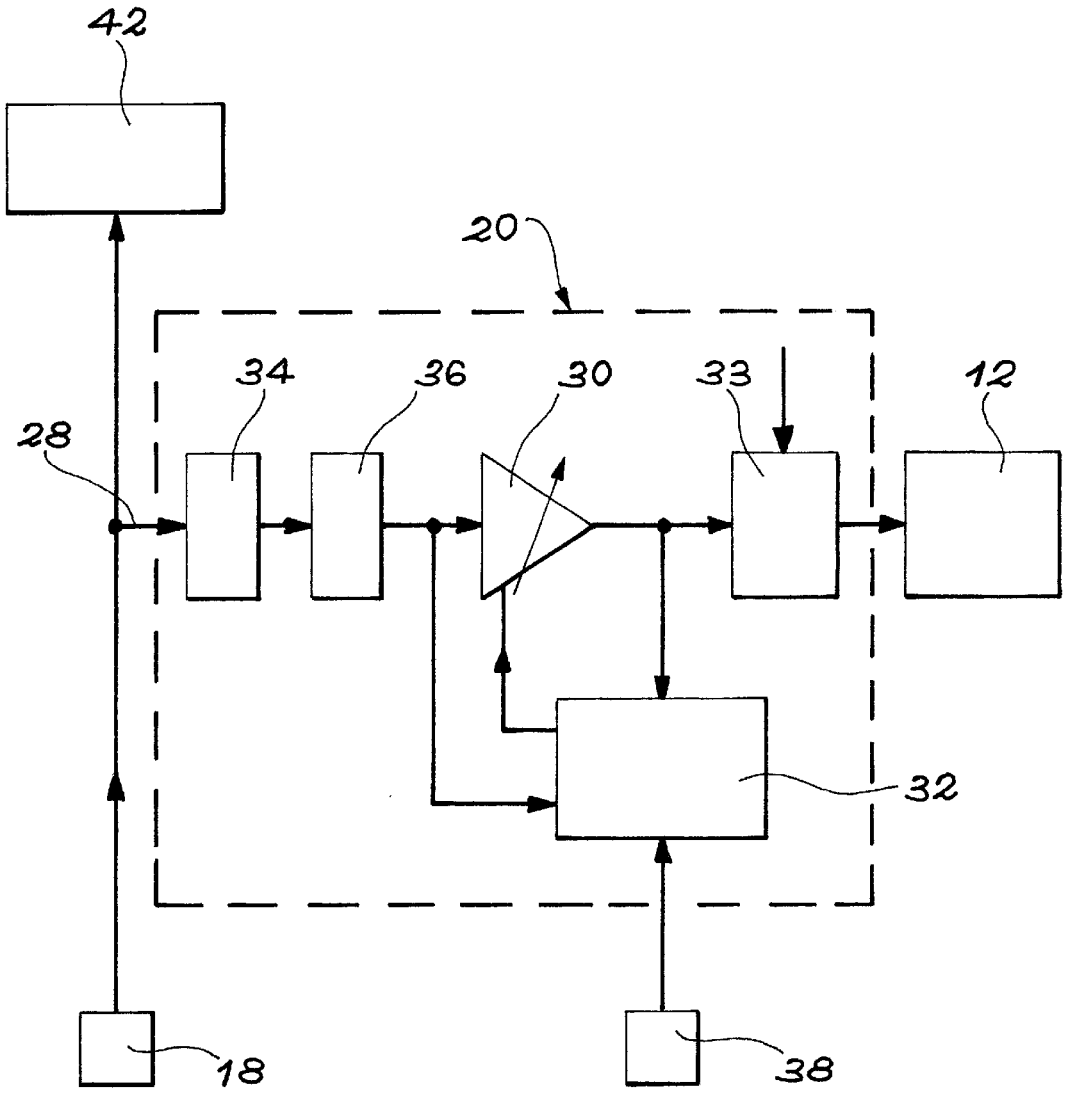

As a non-limitative illustration, a preferred embodiment of the invention is described below with reference to the appended drawings, in which:

FIG. 1, already described, shows the changes in equivalent resistance (in Ohms) of a linen item in relation to the its moisture content (%) for a given value of the signal amplification gain representing this resistance; and FIG. 2 is a very schematic diagram of a drying ironer according to the invention, equipped with means for controlling the moisture content of ironed linen;

FIG. 3 is a perspective view which, on a larger scale, illustrates the means for measuring the moisture content on leaving the machine; and FIG. 4 is a schematic diagram of the control means fitted to the machine in FIG. 2.

DETAILED DESCRIPTION OF A PREFERRED EMBODIMENT OF THE INVENTION

FIG. 2 is a very schematic diagram of a drying ironer with a heated roll fitted, according to the invention, with means for controlling the moisture content of ironed linen items leaving this machine. However, persons skilled in the art will understand that the invention is not limited to this type of machine and also concerns calender drying ironers.

In the case shown of a drying ironer with heated roll, FIG. 2 shows an ironing roll 10, having a horizontal axis, means 12 (such as an electric motor) to drive roll 10 in rotation around its axis, at adjustable speed, and endless fabric belts 14, in contact with part of the circumference of roll 10. The endless fabric belts are mounted on rollers such as 16 whose axes are parallel to the axis of roll 10.

To facilitate the reading of FIG. 2, some component parts of the drying ironer, well known to persons skilled in the art, have not been shown. Among these components in particular are the heating means positioned inside roll 10 and means for aspirating the gas and steam released by the linen through the fabric belts 14.

Ironing of the item linens is made by placing the latter between roll 10 and the fabric belts 14 in a direction corresponding to the direction of rotation of roll 10 (arrow F). The ironed, dried linen items leave the machine via a cylindrical, substantially horizontal part 14*a* of fabric belts 14.

In accordance with the invention, the drying ironer schematically shown in FIG. 2 integrates a device with which it is possible to continuously control the instant moisture content of linen items leaving the machine, so that this content is permanently maintained at a set value irrespective of the moisture content of the linen items when entering the machine. More precisely, the set value is chosen to be sufficiently low to guarantee good microbial quality of the ironed linen, in particular hospital linen.

As will be described more in detail below with reference to FIG. 4, the device for controlling the moisture content of ironed linen items chiefly comprises means 18 for measuring this moisture content and means 20 for monitoring at least one element of the drying ironer able to adjust this content.

The measuring means 18 are positioned at the exit of the drying ironer, precisely above the cylindrical substantially horizontal part 14*a* of the fabric belts 14, in the illustrated embodiment. They are designed to deliver a measurement signal representing the moisture content of the ironed linen items leaving the machine.

In the preferred embodiment of the invention illustrated in FIG. 3, the measuring means 18 comprise two electrically conductive parts 21 and 22, electrically insulated from one another by an insulating block 24.

More precisely, the electrically conductive parts 21 and 22 are metal plates. These plates comprise substantially flat base parts 21*a* and 22*a* which are mounted on a fixed part 26 of the machine, above the cylindrical substantially horizontal part 14*a*, so that they are substantially parallel to one another.

Each of the metal plates forming the electrically conductive parts 21 and 22 also comprises at least two flexible tongues 21*b* and 22*b*, which project beyond the base plates 21*a* and 22*a*. The flexible tongues 21*b* and 22*b* are arranged parallel to each other in alternate fashion and are equidistant from one another. Their end parts are folded along the same plane, tangent to the cylindrical substantially horizontal part 14*a* via which the ironed linen items exit from the machine. Therefore, the ironed linen items leaving the machine are simultaneously in contact with all the end parts of flexible tongues 21*b* and 22*b*.

In the preferred embodiment of the invention illustrated in FIG. 3, each of the metal plates forming the electrically conductive parts 21 and 22 comprises five flexible tongues 21*b* and 22*b*.

The arrangement of the measuring means 18 just described means that at least two and preferably five moisture sensors are formed and arranged in parallel. In this manner a relatively low measurement value is given to the sensitivity of the measuring means, well adapted to the measurement of the very low moisture content generally found at the exit point of drying ironers.

As illustrated in FIG. 4, electric conductors 28 connect the two electrically conductive parts 21 and 22 of measuring means 18 to the control means 20. These electric conductors 28 convey an electric measurement signal, representing the electric resistance between the electrically conductive parts and, consequently, the moisture content of the linen item which may be in contact with tongues 21*b* and 22*b*.

In accordance with the invention, the control means 20 comprise variable gain amplification means 30, for amplifying the measurement signal derived from measuring means 18.

According to the invention, the control means 20 also comprise means 32 for automatically adjusting the gain of amplification means 30. These means 32 for automatic gain adjustment are arranged such that they can give an instant optimised value to the gain of the amplifications means 30, so that the output signal emitted by the amplification means 30 is non-saturated irrespective of the moisture content of the linen items leaving the machine.

In other words, at each instant the means 32 for automatic gain adjustment determine an instant optimised gain for which the output signal delivered by the amplification means has a usable value at all times, that is to say separate from the saturation limits for which variations in the moisture content of the linen do not cause the signal leaving the amplification means to vary.

The control means 20, at the exit of the amplification means 30, therefore deliver a signal which is permanently reflects the moisture contained in the linen items leaving the machine, irrespective of this moisture value.

In practice, the means 32 for automatic gain adjustment may in particular integrate an algorithm which calculates the instant optimised gain from the measurement signal delivered by the measuring means 18.

In the preferred embodiment of the invention, but without being limited thereto, the automatic gain adjustment means initially give the maximum value to the gain of the amplification means 30.

If the output signal of these means is non-saturated, this gain value is taken as the instant optimised value and is maintained for as long as the output signal remains non-saturated.

Conversely, if the output signal of the amplification means is saturated, the means 32 for automatic gain adjustment divide the maximum gain value by a predetermined factor, for example substantially equal to 2 in the preferred embodiment of the invention.

It is then checked again whether or not the output signal from the amplification means 30 is saturated. If not, the maximum gain value after dividing by said factor is taken as the instant optimised value for as long as the output signal remains non-saturated. If this is not the case, the last gain value is again divided by the said factor and so forth until an output signal is obtained which is non-saturated.

The non-saturated output signal so obtained according to the invention, is then compared at 33 with a set moisture content value and used to monitor one ore more elements of the drying ironer able to adjust said content. In the preferred embodiment of the invention illustrated in the figures, this element is the means 12 for driving roll 10 in rotation. More precisely, action is exerted upon these driving means 12 so as to adjust the moving speed of the linen items in the machine. The effect of this adjustment is to bring the moisture content of the linen items leaving the machine to the required set value very quickly.

To complete the description, it is to be noted that before its injection into the amplification means 30, the measurement signal preferably undergoes a smoothing operation in a smoothing circuit 34 and an averaging operation in an averaging circuit 36. Therefore, the measurement signal transmitted to the amplification means 30 does not take into account any erratic measurements and represents the average of a determined number of consecutive measurements.

In addition, in the preferred embodiment of the invention, the algorithm of the means 32 for automatic gain adjustment is designed so that amplification does not need to be systematically recommenced with a maximum gain value when several linen items from one same batch and having substantially the same moisture content are ironed without interruption one after the other.

For this purpose, when the measuring means 18 do not emit any measurement signal indicating the presence of a linen item on the cylindrical substantially horizontal part 14*a*, the algorithm maintains the last instant optimised gain value unchanged for a predetermined length of time after the end of the preceding measurement signal indicating the presence of a linen item on part 14*a*.

Advantageously, the drying ironer of the invention is also fitted with means 38 for measuring the moisture content of linen items to be ironed placed in the drying ironer (FIG. 2). These measuring means 38 may be produced in the same manner as the measuring means 18 previously described. They are mounted on another fixed part 40, above another cylindrical substantially horizontal part 14*b* of endless belts 14, located at the point where the linen items are placed in the machine.

The signal delivered by measuring means 38 is also transmitted to the automatic gain adjustment means 32 (FIG. 4). It may be used in particular to detect the placing of an item of linen in the drying ironer.

As schematically shown in FIG. 4, the measurement signal delivered by the measuring means 18 positioned at the exit of the machine is advantageously recorded in recording means 42 with other data, used in particular to identify the ironed linen items. With this arrangement, it is possible to ensure the traceability of the operations conducted on the machine and more precisely to guarantee good microbial quality of the ironed linen.

Evidently, the invention is not limited to the embodiment just described by way of example. For example, the algorithm used to automatically adjust the gain of the amplifications means 30 to the instant optimal value may be substantially different from the one described. In particular, this algorithm may initially give the gain its lowest value or a preset average value. Also, the means for measuring the moisture content may in some cases be replaced by existing means while remaining within the scope of the invention.

What is claimed is:

1. Method for controlling the moisture content of ironed linen items leaving a drying ironer, according to which the moisture content of the ironed linen items is measured, then at least one element of the drying ironer is monitored according to the measured moisture content, so that it can be moved to a set value, wherein the measured moisture content is amplified with an instant optimised gain so that the measured moisture content so amplified shows a non-saturated value, which is used to monitor said element of the drying ironer.

2. Method according to claim 1, in which the gain is initially given a maximum value, then the gain is divided by a given factor, as many times as necessary until the measured, amplified moisture content shows said non-saturated value.

3. Method according to claim 1, in which, if no measurement is made of the moisture content of an ironed item of linen, the instant optimised gain is kept unchanged for a predetermined length of time after the end of the measurement of the moisture content of the last item of linen ironed.

4. Method according to claim 1, in which successive measurements of the moisture content are taken, the measurement signals are smoothed and their average is calculated before they are amplified with said instant optimised gain.

5. Drying ironer comprising means for measuring the moisture content of ironed linen items leaving the drying ironer, said measuring means being able to deliver a measurement signal in the presence of an item of linen, and control means sensitive to the measurement signal so as to adjust the moisture content by acting on at least one element of the drying ironer, wherein the control means comprise variable gain amplification means for amplifying the measurement signal, and means for automatic gain adjustment able to give an optimised value to the gain of the amplification means so that the amplifications means emit a non-saturated output signal.

6. Drying ironer according to claim 5, in which the automatic adjustment means initially give the gain a maximum value, then divide the gain by a given factor, as many times as is necessary, until said optimised value is obtained.

7. Drying ironer according to claim 5 in which, in the absence of a measurement signal, the automatic adjustment means maintain the gain at said optimised value for a predetermined length of time after the end of the last measurement signal.

8. Drying ironer according to claim 5, in which the control means comprise smoothing means and averaging means.

9. Drying ironer according to claim 5, in which the element on which the control means act are means for adjusting the conveying speed of the linen items in the drying ironer.

10. Drying ironer according to claim 5, in which the means for measuring moisture content comprise two electrically conductive parts each comprising at least two flexible tongues able to contact simultaneously the items of linen leaving the drying ironer, the flexible tongues of the two conductive parts being arranged in alternate manner so as to form as many element sensors as there are pairs arranged in parallel.

11. Drying ironer according to claim 5, also comprising means for measuring the moisture content of linen items to be ironed entering the drying ironer.

12. Drying ironer according to claim 5, also comprising means for recording the measurement signal.

* * * * *